US005510817A

United States Patent [19]

Sohn

[11] Patent Number: 5,510,817

[45] Date of Patent: Apr. 23, 1996

[54] WRITING METHOD FOR INK JET PRINTER USING ELECTRO-RHEOLOGICAL FLUID AND APPARATUS THEREOF

[75] Inventor: Sang-suk Sohn, Suwon, Rep. of Korea

[73] Assignee: Samsung Electronics Co, Ltd., Kyungki-do, Rep. of Korea

[21] Appl. No.: 994,908

[22] Filed: Dec. 22, 1992

[30] Foreign Application Priority Data

Sep. 30, 1992 [KR] Rep. of Korea ..... 92-17897

[51] Int. Cl.[6] ..... B41J 2/015

[52] U.S. Cl. ..... 347/21; 347/100; 347/54

[58] Field of Search ..... 346/1.1, 75, 140; 347/21, 100, 54

[56] References Cited

U.S. PATENT DOCUMENTS 2,925,312 2/1960 Hollmann ..... 346/140 X

FOREIGN PATENT DOCUMENTS 28819 2/1980 Japan ..... B41J 3/04
78755 5/1985 Japan ..... B41J 3/04
229764 11/1985 Japan ..... B41J 3/04
122553 5/1988 Japan ..... B41J 3/04

*Primary Examiner*—Joseph W. Hartary
*Attorney, Agent, or Firm*—Rothwell, Figg, Ernst & Kurz

[57] ABSTRACT

A writing method is disclosed for an ink jet printer using an electro-rheological fluid wherein an electro-rheological fluid reservoir is provided in between static pressure tubes circuitously communicating with a larger-diameter portion and a smaller-diameter portion of a venturi tube. The pressure difference created in the venturi tube forces the injection of the electro-rheological fluid, and a writing potential is applied to the exit of the static pressure tubes from which the electro-rheological fluid is ejected so as to control the ejected amount.

8 Claims, 3 Drawing Sheets

WRITING METHOD FOR INK JET PRINTER USING ELECTRO-RHEOLOGICAL FLUID AND APPARATUS THEREOF

BACKGROUND OF THE INVENTION

1. Field of the Invention

The present invention relates to a method and apparatus for writing images using ink and, particularly, to a writing method for an ink jet printer using electro-rheological fluid and apparatus thereof which controls the ejection of ink by using an electrical potential for varying the viscosity of the fluid and a pressure difference of a venturi tube.

2. Description of the Background Art

Electro-rheological fluid is well-known for its electro-field responsiveness. The electro-rheological fluid was first disclosed in U.S. Pat. No. 2,417,850 by Winslow in 1943, and has been proposed in various forms in U.S. Pat. No. 3,047,057 by Winslow, USSR patent 1391951 by Lysenkov and U.S. Pat. No. 4,812,251 by Stangroom.

Such electro-rheological fluids proposed by the aforementioned publications are basically made of electric-viscosity liquid containing a powdery additive of a minute particle diameter which, if an electric field is applied thereto, become varied in the viscosity. Here, viscosity has been known to vary proportional to the strength of the applied electric field, which is referred to as electric viscosity effect. The electric viscosity effect is that the viscosity of a fluid is varied depending on the strength of an applied electric field, and varies almost concurrently with the electric field application. Among the above-described electro-rheological fluids, there is one whose viscosity varies from a liquid state to a nearly solid state even by an electric field below 10 KV/mm.

Utilizing ink made with electro-rheological fluid and an appropriate controller, written images can be created. Technology for writing images using such electro-rheological ink has been disclosed (IS&T conference 91' 11).

A conventional head for ejecting such electro-rheological ink is illustrated in FIG. 1 which utilizes a nozzle sheet 1 and a pair of support sheets 2 and 3 that are stacked above and below the nozzle sheet respectively. Nozzle sheet 1 has an ink reservoir 1*a* for receiving ink of a certain quantity and a nozzle 1*b* for ejecting ink therefrom. Upper support sheet 2 has an ink supplying aperture 2*a* and an electrode plate 4, and lower support sheet 3 has another electrode plate 4'. In this configuration, a predetermined pressure is kept with respect to the inside and outside of nozzle 1*b*. The viscosity of the ink inside the nozzle is varied according to a writing potential, illustrated schematically at reference numeral 5, applied to a pair of electrode plates 4 and 4'. When the ink has a low viscosity, i.e. liquid, the ink is ejected due to the pressure difference between the inside and outside of the nozzle. That is, the viscosity of the ink inside the nozzle is varied by the strength of the electric field formed by the two electrodes, so that the ink is ejected when it has a high viscosity, i.e. nearly solid, and is not ejected when the ink has a low viscosity. Such a technology for ejecting electro-rheological ink according to the writing potential requires an additional means for creating the pressure difference inside and outside the nozzle and holding the pressure difference. This causes the apparatus to be complicated and expensive while impeding its miniaturization.

SUMMARY OF THE INVENTION

Therefore, it is an object of the present invention to provide a writing method for an ink jet printer using an electro-rheological fluid which enables the electro-rheological fluid to jet at low pressure and low voltage.

It is another object of the present invention to provide an apparatus which accomplishes the above writing method.

To accomplish the first object, a writing method is provided for an ink jet printer using an electro-rheological fluid wherein an electro-rheological fluid reservoir is provided in the middle of static pressure tubes circuitously communicating with a larger-diameter portion and a smaller-diameter portion of a venturi tube on which a predetermined pressure acts. The pressure difference in the venturi tube forces the ejection of the electro-rheological fluid. Also, the ejected amount of electro-rheological fluid is controlled by applying a writing potential to the exit of the static pressure tubes from which the electro-rheological fluid is ejected.

To accomplish the second object, a writing apparatus is provided for an ink jet printer using an electro-rheological fluid comprising means for producing pressure and a venturi tube which has a larger section at the entrance and a smaller section at the exit so as to produce the pressure difference at the entrance and exit by the pressure producing means. The writing apparatus further comprises static pressure tubes circuitously communicating with the larger-diameter and smaller-diameter of the venturi tube and an electro-rheological fluid reservoir installed in the middle of the static pressure tubes. An ink valving means is also provided for controlling the flow of ink at the exit of the static pressure tube.

In the present invention, the viscosity of the electro-rheological fluid is varied by the ink valving means, and a pressure difference is produced in the venturi tube by the pressure producing means to eject the electro-rheological fluid. The ejection of the fluid is made possible even under the conditions that the ink valving means has a low voltage and the pressure difference of the venturi tube is low. Further, the pressure producing means and the ink valving means are installed inside the venturi tube, thereby simplifying the structure.

BRIEF DESCRIPTION OF THE DRAWINGS

The above objects and other advantages of the present invention will become more apparent by describing in detail a preferred embodiment thereof with reference to the attached drawings in which.

DETAILED DESCRIPTION OF THE INVENTION

Figure 1:
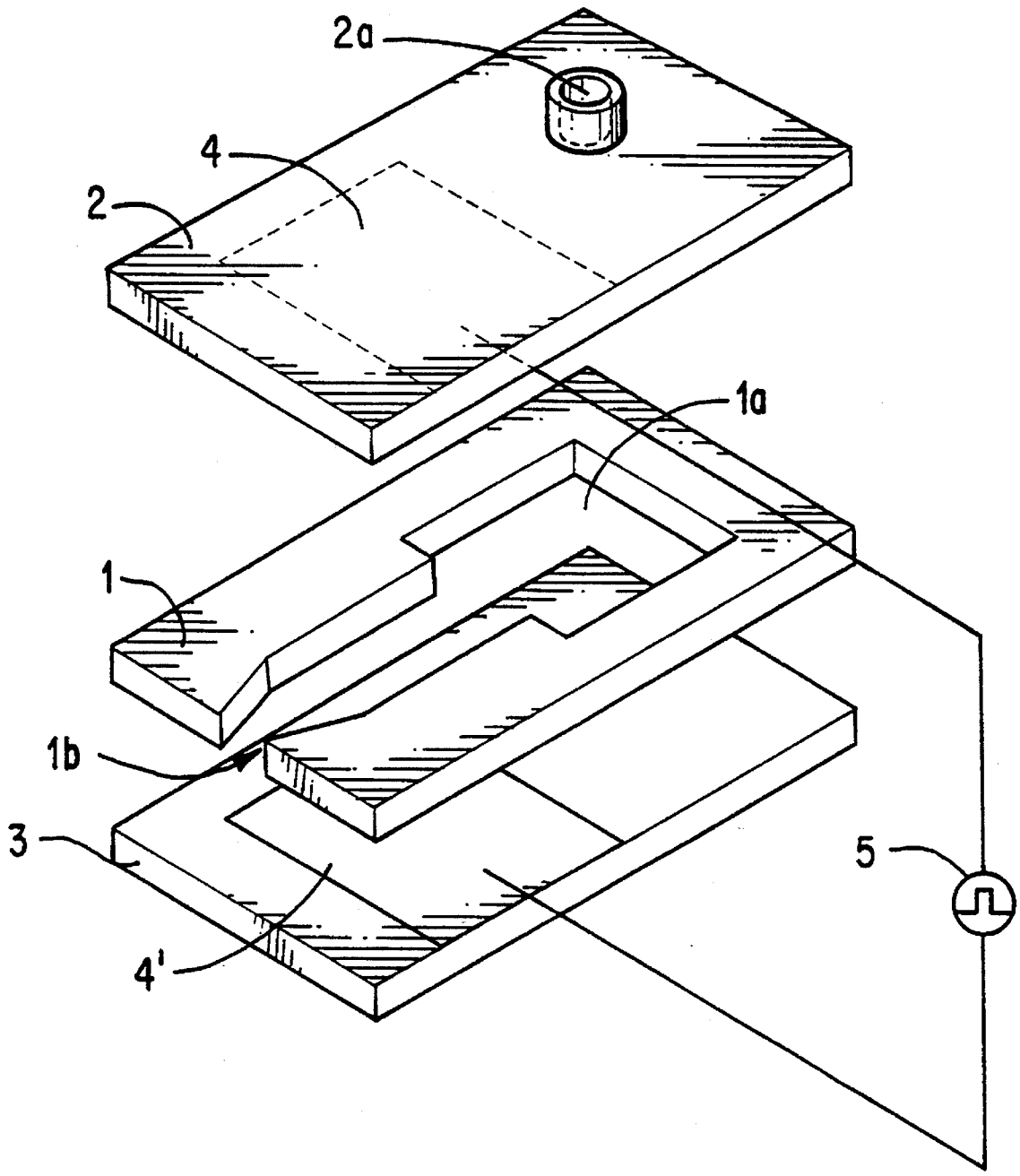
FIG. 1 (PRIOR ART)
FIG. 1 shows a conventional ink jet printer head.
Figure 2:
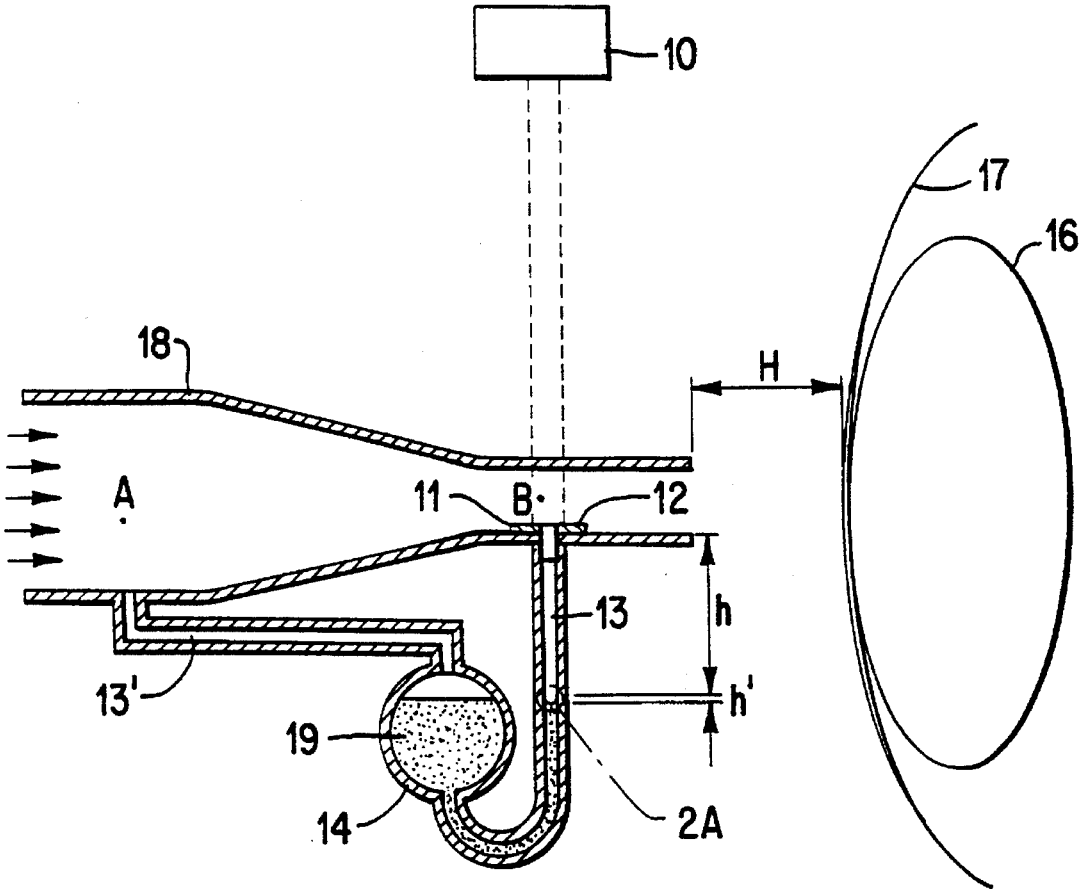
FIG. 2 is a schematic view of a device for injecting the electro-rheological fluid in the ink jet printer according to the present invention.
Figure 2A:
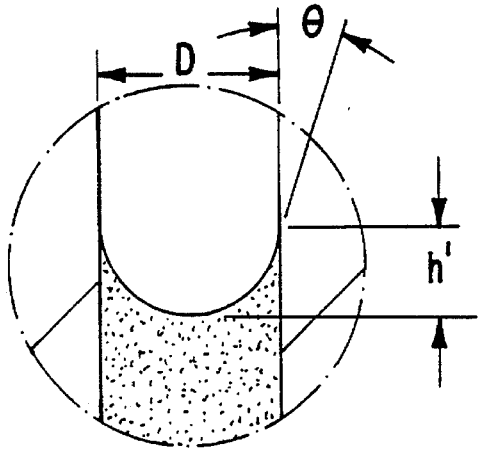

Referring to FIG. 2, reference number 18 represents a venturi tube having static pressure tubes 13 and 13' connecting two points A and B of different passage sections and filled with electro-rheological fluid 19. An ink valving means is provided comprising two opposing writing electrodes 11 and 12 to which a writing potential signal is applied. The writing electrodes 11 and 12 are provided on the side of static pressure tube 13 which is connected at point B of the smaller section. Writing electrodes 11 and 12 are connected to a writing signal generator 10 and a writing potential representing a printing signal is applied to the electrodes. Static pressure tube 13' has a reservoir 14 for storing predetermined quantities of electro-rheological fluid 19. Reservoir 14 is connected to a fluid supply tank (not shown) to be continuously supplied with the electro-rheological fluid so that the fluid in the reservoir keeps a specific height. Venturi tube 18 has a pressure generating means (not shown) for producing the pressure difference between points A and B. The pressure generating means forces air to flow at high speed from point A of the larger section to point B of the smaller section, so that pressure is lower at point B of the smaller section. The pressure generating means can be a suitable means for creating air flow, such as a fan.

Figure 3:
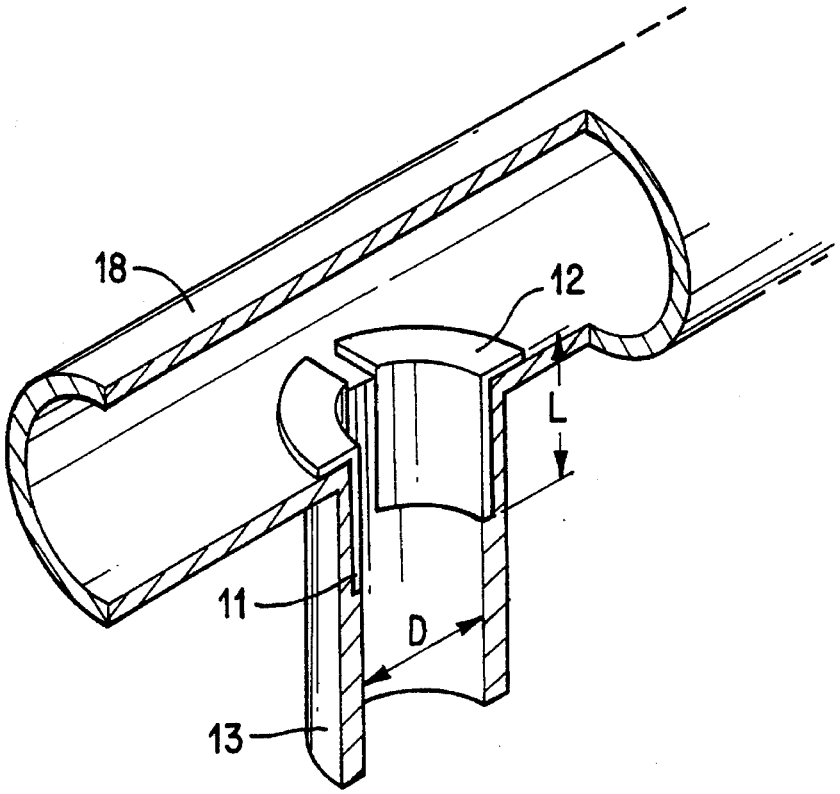
FIG. 3 is a cutaway perspective view for an important part of the venturi tube according to the present invention.

As illustrated in FIG. 3, writing electrodes 11 and 12 are inserted into static pressure tube 13 to a predetermined length. The exit of venturi tube 18 is positioned so that it is spaced apart from paper 17, conveyed by a platen 16, by a specific interval H, as shown in FIG. 2.

The operation of the writing apparatus using electro-rheological fluid of the present invention will be described below.

First, for instance, if a fan (not shown) forces air to flow from point A to point B at high speed, a pressure difference is produced between points A and B. Then, electro-rheological fluid 19 flows to static pressure tube 13 of the lower pressure point B. At the same time, when the writing potential produced by writing signal generator 10 is applied to writing electrodes 11 and 12, the viscosity of electro-rheological fluid 19 is varied according to the strength of the potential thereby varying the shearing yield stress of electro-rheological fluid 19. Accordingly, due to the shearing yield stress of electro-rheological fluid 19 determined by the strength of the applied writing potential and the ejection force difference of electro-rheological fluid 19 due to the pressure difference, the amount of electro-rheological fluid 19 ejected onto paper 17 is controlled.

The pressure difference between A and B can be set according to Bernoulli's equation and a continuity equation, as follows:

$$P_A - P_B = \gamma_a[V_B^2/2g(1-(A_A/A_B)^2)+(Z_B-Z_A)+h_L]$$

where, $P_A$ and $P_B$ are pressures at A and B;

$\gamma_a$ is the specific weight of air;

$Z_A$ and $Z_B$ are heights at A and B with respect to a specific reference;

$A_A$ and $A_B$ are sectional areas;

$h_L$ is loss; and $V_B$ is air speed at B.

Thus, the pressure difference between points A and B is determined by the above factors in the above equation. Here, if the pressure difference between A and B is set to be greater than $_\gamma h$ (see FIG. 2), electro-rheological fluid 19 can be ejected from static pressure tube 13. That is, electro-rheological fluid 19 ejected from static pressure tube 13 is ejected at an ejecting pressure of $P_i=(P_A-P_B)-{}_\gamma h$. Here, since ejecting height h is not substantially more than 10 mm, the rising height of capillary h' is considered. The rising height of capillary h' may be expressed as $h'=4\sigma\cos\theta/{}_\gamma D$. Here, $\sigma$ is the surface tension of electro-rheological fluid and D is the diameter of static pressure tube 13.

Meanwhile, the shearing yield stress $\tau$ of electro-rheological fluid 19 is defined as $\tau=F/\pi DL$, and the ejecting pressure as $P_i=4F/\pi D^2$. Here, F is the ejection force from static pressure tube 13, D is the diameter of static pressure tube 13, and L is the length of writing electrodes 11 and 12. If the shearing yield stress is set to be greater than the ejecting pressure, that is, $\tau>P_iD/4L$, the injecting of electro-rheological fluid 19 can be controlled. Here, the shearing yield stress of electro-rheological fluid 19 is varied according to the strength of the potential applied to writing electrodes 11 and 12.

This can be expressed as follows in connection with the above equations.

$$\tau>D/4L[_{\gamma a}\{V_B^2/2g(1-(A_A/A_B)^2)+(Z_B-Z_A)+h_L\}-{}_\gamma h]$$

Therefore, if the shearing yield stress of electro-rheological fluid 19 satisfies the above equation, ejecting the ink from static pressure tube 13 can be controlled.

Figure 4:
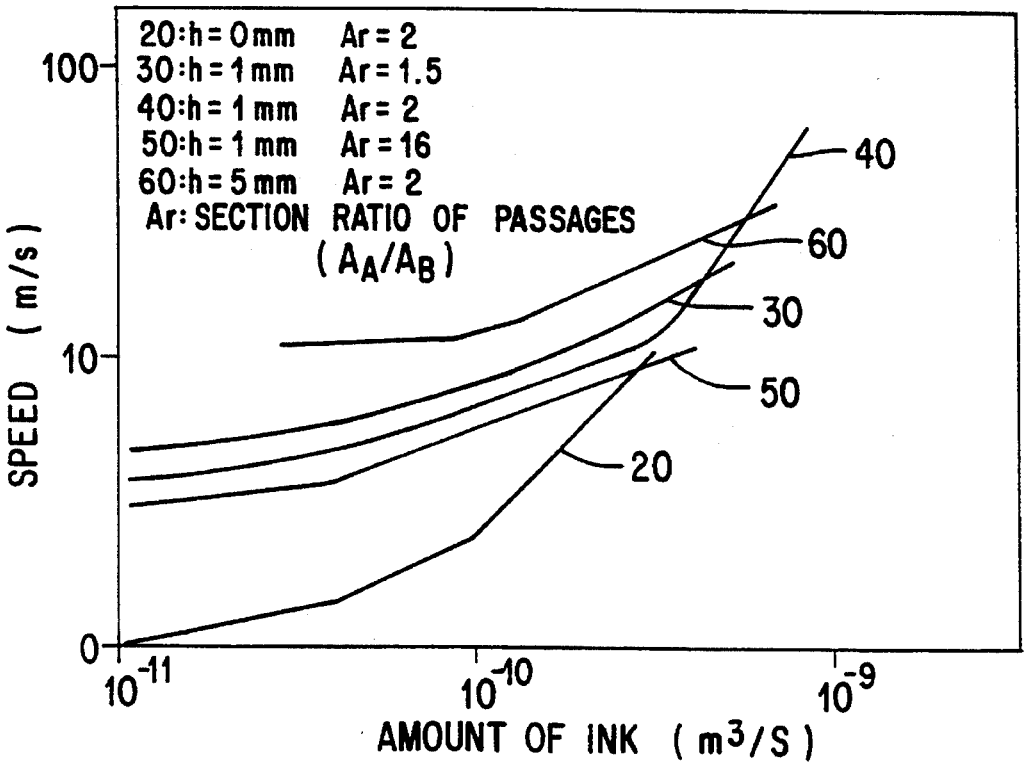
FIG. 4 illustrates the relationship of the average speed at the venturi exit and the ejection amount at the static pressure tube according to the present invention.

FIG. 4 illustrates the relationship of the average speed at the venturi exit and the ejection amount at the static pressure tube with respect to a set passage section ratio ($A_A/A_B$) and the injection height h according to an embodiment of the present invention. Here, the mean required amount of ink to print a dot is $10^{-10}$ liters. To print five A4 sheets per minute at 400 dpi (dot per inch), an injection amount of about $5.46\times10^{-11}$ $mm^3$ per second is required. As shown in FIG. 4, in order to eject electro-rheological fluid 19 at $5.46\times10^{-11}$ $mm^3$ per second, it is sufficient that the speed of the venturi exit, though depending upon factors in the above equations, is above 15 m per second. To produce the exit speed of air, a discharge pressure of $P_P={}_{\gamma a}V^2/2$ g (where $_{\gamma a}$ is the specific weight of air) of a pump should be about $1.4\times10^{-3}$ atm. This can be sufficiently accomplished even with an ordinary fan.

As described above, since the writing method for an ink jet printer using an electro-rheological fluid and apparatus thereof according to the present invention does not need high pressure nor high voltage, it is favorable to high integration and low-cost production. Further, since the ejecting force of ink at the ink outlet is low and, thus, allowing for low shearing yield stress of the electro-rheological fluid, the present invention is advantageous in selecting a electro-rheological fluid and lowering its cost. Furthermore, the ink outlet is simplified and is not deformed by high temperature or high pressure, thereby making the life of the outlet semipermanent.

What is claimed is:

1. A writing method for an ink jet printer using an electro-rheological fluid which ejects the electro-rheological fluid so as to write images on paper, said method comprising:

(a) providing an electro-rheological fluid reservoir between static pressure tubes circuitously communicating with a larger-diameter portion and a smaller-diameter portion of a venturi tube on which a predetermined pressure acts;

(b) creating a pressure difference in said venturi tube which can force the ejection of said electro-rheological fluid; and (c) applying a writing potential to the exit of said static pressure tubes from which said electro-rheological fluid is ejected so as to control the ejected amount.

2. A writing method for an ink jet printer using an electro-rheological fluid as claimed in claim 1, wherein a shearing yield stress of said electro-rheological fluid is set to be greater than the pressure difference produced by the variation of the passage sections.

3. A writing apparatus for an ink jet printer using an electro-rheological fluid so as to write images on paper, said apparatus comprising:

(a) means for producing pressure;

(b) a venturi tube which has a larger section at an entrance thereof and a smaller section at an exit thereof so as to produce the pressure difference at the entrance and exit by said pressure producing means;

(c) static pressure tubes circuitously communicating with the larger section and smaller section of said venturi tube;

(d) an electro-rheological fluid reservoir installed in between said static pressure tubes; and (e) ink valving means for controlling the flow of ink at the exit of said static pressure tube.

4. A writing apparatus for an ink jet printer using an electro-rheological fluid as claimed in claim 3, wherein as said pressure producing means comprises a fan for supplying air.

5. A writing apparatus for an ink jet printer using an electro-rheological fluid as claimed in claim 3, wherein an additional fluid supply tank is connected to supply the fluid to keep the fluid in said reservoir at a predetermined height.

6. A writing apparatus for an ink jet printer using an electro-rheological fluid as claimed in claim 3, wherein said ink valving means comprises a writing electrode at the exit of said static pressure tube inside said venturi tube.

7. A writing at apparatus for an ink jet printer using an electro-rheological fluid as claimed in claim 6, wherein said writing electrode comprises two opposite electrodes and is inserted into said static pressure tube by a predetermined length.

8. The writing apparatus for an ink jet printer using an electro-rheological fluid as claimed in claim 3, wherein said electro-rheological fluid reservoir is positioned in the middle of said static pressure tubes.

* * * * *